US010213798B2

(12) United States Patent
Zaarbelink

(10) Patent No.: US 10,213,798 B2
(45) Date of Patent: Feb. 26, 2019

(54) PARTLY DISPOSABLE PLUG AND SPRAY SYSTEM FOR A TWO COMPONENT ADHESIVE

(71) Applicant: STRONGBOND B.V., Dinxperlo (NL)

(72) Inventor: Antonius Wilhelmus Zaarbelink, Dinxperlo (NL)

(73) Assignee: STRONGBOND B.V., Dinxperlo (NL)

( * ) Notice: Subject to any disclaimer, the term of this patent is extended or adjusted under 35 U.S.C. 154(b) by 107 days.

(21) Appl. No.: 15/146,637

(22) Filed: May 4, 2016

(65) Prior Publication Data

US 2016/0318050 A1 Nov. 3, 2016

Related U.S. Application Data

(63) Continuation of application No. PCT/NL2014/050763, filed on Nov. 4, 2014.

(30) Foreign Application Priority Data

Nov. 4, 2013 (NL) ..... 2011724

(51) Int. Cl.
*B05B 7/24* (2006.01)
*B05B 9/043* (2006.01)
*B05B 12/00* (2018.01)

(52) U.S. Cl.
CPC ..... *B05B 7/2481* (2013.01); *B05B 7/2472* (2013.01); *B05B 7/2497* (2013.01); *B05B 9/043* (2013.01); *B05B 12/008* (2013.01)

(58) Field of Classification Search
CPC ... B05B 7/2481; B05B 7/2472; B05B 7/2497; B05B 12/008; B05B 9/043
USPC ..... 239/302–304, 306, 323, 327, 328, 525, 239/528, 373; 222/135, 145.4, 145.5, 107
See application file for complete search history.

(56) References Cited

U.S. PATENT DOCUMENTS

| | | | | |
|---|---|---|---|---|
| 3,613,956 | A * | 10/1971 | McCulloch | B65D 5/5011 222/145.4 |
| 3,832,427 | A | 8/1974 | Mutch | |
| 7,021,500 | B1 | 4/2006 | Finn et al. | |
| 7,306,119 | B2 * | 12/2007 | Wootton | B01F 5/0256 222/145.5 |
| 2010/0301064 | A1 * | 12/2010 | Munro | E04F 21/085 222/135 |
| 2011/0192864 | A1 | 8/2011 | Rueschhoff et al. | |
| 2012/0181301 | A1 * | 7/2012 | Choiniere | B05B 9/007 222/1 |

FOREIGN PATENT DOCUMENTS

| | | |
|---|---|---|
| FR | 2411318 | 6/1979 |
| WO | 2012/071376 | 5/2012 |
| WO | 2015/065195 | 5/2015 |

* cited by examiner

*Primary Examiner* — Steven J Ganey
(74) *Attorney, Agent, or Firm* — Peacock Law P.C.; Janeen Vilven; Camille Martinez

(57) ABSTRACT

A partly disposable system for a two component adhesive, a coupler for use in such a system, a disposable container comprising an adhesive component, and a method of filling disposable system. The disposable system comprises a first disposable container for a first component, and a second disposable container for a second component, each container being capable of withstanding a pressure of 100 kPa-600 kPa.

12 Claims, 4 Drawing Sheets

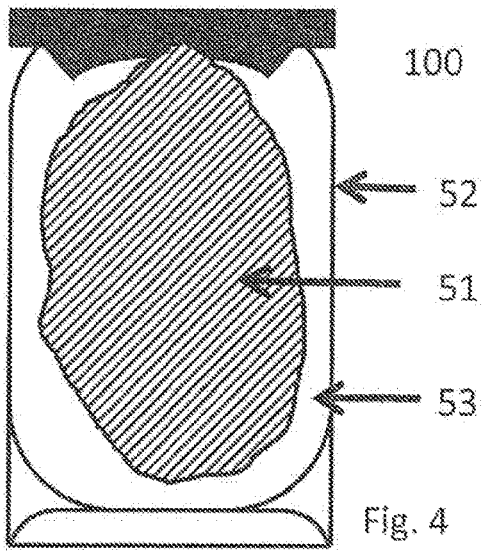
Fig. 4
Fig. 5
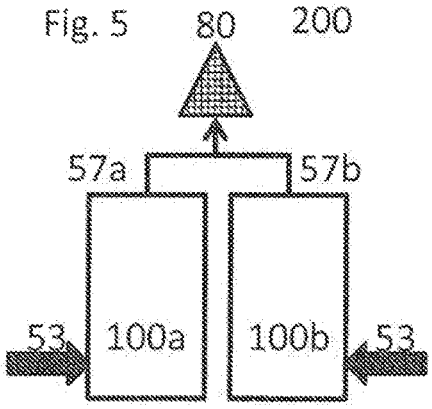

PARTLY DISPOSABLE PLUG AND SPRAY SYSTEM FOR A TWO COMPONENT ADHESIVE

CROSS-REFERENCE TO RELATED APPLICATIONS

This application is a continuation of International Patent Application No. WO2015/065195 A1, filed Nov. 4, 2014, in the name of "Saba Dinxperlo B.V.", which PCT-application claims priority to Netherlands Patent Application Serial No. 2011724, filed Nov. 4, 2013, in the name of "Saba Dinxperlo B.V.", and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

Field of the Invention (Technical Field)

The present invention is in the field of a partly disposable system for a two component adhesive, a coupler for use in such a system, a disposable container comprising an adhesive component, and a method of filling disposable system.

BACKGROUND OF THE INVENTION

In manufacturing of larger objects, such as matrasses, and furniture adhesives are often applied to fix parts of the large object together. Most adhesives are applied using either air-spray equipment or air-assisted spray equipment.

The present invention relates to using airless-spray equipment and using air-assisted spray equipment. Airless spraying involves using pressure to force a fluid to be sprayed through a small orifice. Airless spray equipment is often operated at lower pressures than air-spray- or air assisted-spray equipment.

Methods and products for applying a layer of adhesive onto a surface wherein the method comprises spraying the adhesive airlessly are known in the prior art.

The prior art methods typically make use of rather complicated equipment. Therein components of adhesives are provided in relatively large containers, e.g., of a few hundred liters. In order to transfer a component from the container to, e.g., a spray equipment pressure is provided to the container, such as air-pressure. Pressure for spraying may be provided by positive displacement pumps, such as double diaphragm pumps or piston pumps; pressurized systems such as pressure tanks; and, gravity feed feeding systems. Such systems are rather voluminous, complex and costly. By providing pressure an adhesive component is typically transferred through a tube or the like to the spray equipment.

As an amount of adhesive used in prior art systems is typically much smaller than a content of a container there is a risk that the component may clog, block a tube, etc. Such requires cleaning of the equipment.

The prior art equipment is typically (somewhat) difficult to handle, e.g., in terms of relocating, and replacing feed stock. It requires typically relative complicated supporting equipment, such as pressure devices, pumps, controls, etc. Also, in view of complexity, such systems are at a certain distance from a location where the adhesive is being applied; inherently such involves some further risks, e.g., clogging of tubing, less control at the location of application, etc.

Some prior art documents recite dispensing systems.

For instance, US2011192864 (A1) recites a system for dispensing polyurethane foam from DOT-39 compliant tank, including a compressor having an outlet through which air is supplied, and a booster coupled to the outlet of the compressor. The booster provides a supply of compressed air at a relatively high pressure of between about $1.1*10^3$ kPa (160) and about $1.38*10^3$ kPa (200 pounds per square inch). This system uses high pressure compressed air to empty 25 liter bladderless tanks (having no liner). The system is used for polyurethane foam, and by providing two containers of which at least one is pressurized a controlled release of polyurethane is obtained. The system is not considered suitable for a two component adhesive.

WO2012071376 (A2) recites disposable dispensers. The dispenser may include a dispense assembly comprising an outlet channel in fluid communication with a terminal apparatus, and a pressure source providing a limited supply of fluid or gas, and also includes a collapsible liner that contains a material to be dispensed, the liner detachably secured to the dispense assembly with the outlet channel in fluid communication with an interior of the liner, wherein the material in the liner is dispensed out the liner and through the outlet channel to the terminal apparatus. The document recites a dispensable pressure source that is limited in supply; such a dispenser is clearly not suited for (semi-)continuous use, as the supply would need to be replaced again and again. The pressure applied is not indicated, but seems to be lower than 10 kPa, in any case a relatively low pressure; hence the system is not considered suited for higher pressures, such as with the present invention and the above document as it may explode. The volume of the system seems to be rather small. Also the goal of this disclosure relates to preventing exposure of the dispensing material and to reduce damage caused by a dispensing material by operating at a low pressure. The dispensed materials relate to pesticides, fertilizer, cleaning solutions, etc. It is preferred not to apply a shear force when applying the dispensing material, as such a force is considered to damage the material.

U.S. Pat. No. 7,021,500 (B1) recites a transportable two-component fluid dispensing kit. The kit includes a container having a front panel and rear panel joined by side panels to form a chamber.

It is therefore an object of the present invention to provide a partly disposable system for a two component adhesive which overcomes one or more of the above disadvantages, without jeopardizing functionality and advantages.

BRIEF SUMMARY OF THE INVENTION

The present invention relates to a partly disposable plug and spray system for a two component adhesive according to claim 1, a coupler for use in said system according to claim 11, a method of filling the system according to claim 13 and a disposable container filled with a first or second component according to claim 14. Therewith an easy to install, adaptable, replaceable, lightweight, small and simple system is provided.

In view of the-two component adhesive two containers are provided, a first disposable container for a first component, and a second disposable container for a second component. Upon applying pressure the two components are transported to, e.g., a spraying gun, mixed an applied to, e.g., a surface. Each container is capable of withstanding a pressure of 10 kPa-1000 kPa. In view of said pressure many materials can be used for an inner vessel and outer wall of the container, respectively. It is noted that, e.g., low pressure prior art systems, such as mentioned above, are not suited in view of optional higher pressures ranges (300-1000 kPa) used in the present invention. The materials are disposable and preferably of a low density.

In a preferred embodiment a pressure may be 20 kPa-600 kPa, more preferably 50 kPa-500 kPa, such as 70 kPa-350 kPa. In some examples the pressure can be 100 kPa-250 kPa. With such a relative low pressure the components are transported to the application means, e.g., a spraying gun. The pressure may be adapted to characteristics of a component, such as viscosity thereof, and characteristics of tubes and spray equipment. In view of construction lower pressure ranges are preferred. In view of, e.g., shear forces higher ranges are preferred.

The outer wall and an inner flexible vessel are for shielding the component from air and for pressurizing the component. Preferably they have a low permeability for the components being used and for harmful gasses in the environment, such as oxygen.

The present system provides a lightweight easy replaceable system, that can be put into use with readily available means, such as pressurized air, a coupler (according to the invention) and a means for spraying.

For some production facilities, having various locations where an adhesive is applied, it is an advantage that the present system can me moved from one location to another, e.g. because the present system can be fully integrated on a wheel assisted frame, such as a lorry. Such is especially appreciated for specialty applications.

In view of typically applied gravity assisted systems, the present system provides a better control of amount of adhesive applied, of initial tack, of overspray, of spray pattern and of shear force. The relevant parameters can be controlled and regulate very well.

It is also an advantage that with a relatively very low investment an system for a two component adhesive is provided.

The present invention provides a strong bond.

Thereby the present invention provides a solution to one or more of the above mentioned problems.

Advantages of the present description are detailed throughout the description.

DETAILED DESCRIPTION OF THE INVENTION

The present invention relates in a first aspect to a hot melt adhesive composition according to claim 1.

In an example the present system comprises a means for pressurising the first and second container, such as pressurized air, preferably provided by one or more of a pressurized air conduit, a compressor, and a pressurized air cylinder. Typically a pressure of 100 kPa-350 kPa is provided. Such a pressure can be generated with relatively easy means.

In an example of the present system the containers are formed of a material having a density of less than 1.4 kg/dm$^3$, preferably 0.5-0.95 kg/dm$^3$. The density of the material is preferably as low as possible, e.g., in view of labor restrictions to carrying weight by employees.

In an example of the present system the containers have a volume of 10-100 dm$^3$, preferably 20-50 dm$^3$, more preferably 25-30 dm$^3$. A preferred volume is 25 dm$^3$. A container filled with a first or second component, the components having a density of about 1 kg/dm$^3$, can preferably be relocated by an employee without much trouble. In view of relocating smaller volumes are preferred, whereas in view of replacing larger volumes are preferred. For some applications relatively small volumes are very well suited.

In an example of the present system a material of the inner flexible vessel is made of an inert material. The material is preferably capable of withstanding a first or second component, respectively, and provides long storage and use periods of time. The material is preferably chosen from polyethylene (PE), polyethylene terephthalate (PET), polypropylene (PP), more preferably PE.

In an example of the present system the outer wall is made of a polymer material, such as PET. The outer wall may be made of a somewhat more robust material, e.g., in order to withstand damage, collision, transport, etc.

In an example of the present system a material of the inner flexible vessel further comprises a reflecting material, such as an aluminium sheet, preferably provided on an outside thereof. Such a reflecting material preferably blocks UV-light from entering into the inner vessel. The reflecting material further prevents sunlight from entering to some extend as well, thereby keeping the temperature of the component more constant. The reflective material may also prevent harmful gasses and the like from entering into the vessel. As such longer storage and use times are provided.

In an example of the present system the inner vessel is provided with an outlet and a connection means for connecting a tube. Such makes the present system easy to use, and provides direct access to the adhesive. Without any difficulty the present adhesive can be applied.

In an example of the present system a space between the inner vessel and outer wall is designed to pressurize the inner vessel. It is preferred to apply pressure between the inner vessel and outer wall. Thereto especially the outer wall need to be capable of withstanding a pressure applied. The content of the inner vessel, i.e., the first or second component, is squeezed out towards and through an outlet.

In an example of the present system the first component is selected from a poly-chloroprene dispersion, polyurethane dispersion, polyacrylate dispersion, vinylacetate-ethylene dispersion, ethylene-vinylacetate dispersion, natural rubber dispersion, styrene-butadiene-styrene copolymer dispersion and styrene-butadiene rubber dispersion, and mixtures thereof. The present system is very suited for adhesive compositions and can be put into practice directly.

In an example of the present system the second component is a coagulant, for example selected from a salt of a multivalent metal such as zinc, aluminium or calcium; or an acid solution, such as selected from citric acid, formic acid, acetic acid, lactic acid and mineral acid having a pH below 5, preferably below 4.5, most preferably below 4, and mixtures thereof.

The present system is very suited for adhesive compositions and can be put into practice directly.

In an example the present system further comprises a 2K air assisted spray gun or a 2K airless spray gun. Thereto some adjustments to the spray gun and to the system have been provided. With these adjustments the spray gun and system can be connected with ease.

In an example the present system further comprises one or more of a means for connecting, such as a coupler, such as a bayonet coupling, a means for regulating pressure, a means for monitoring pressure, a valve, a handle, a tube for providing pressure, a tube for providing the first component to a spray gun, and a tube for providing the second component to a spray gun, wherein the tubes are preferably colour coded.

The coupler is especially designed and fitted for the present system. As such an easy to use system is provided.

In view of various applications it is preferred to have a means for regulating pressure, such that a good spray pattern and good adhering is obtained. Also an amount of overspray can be regulated precisely. If correctly used an amount of overspray is practically absent.

In use it is often preferred to monitor pressure, especially changes therein. It is preferred to use a constant pressure.

In view of use tubes are provided, for transporting a first and second component to a spray gun, respectively, and for applying pressure to the first and second component, respectively. In order to prevent mistakes the tubes are preferably colour coded, e.g., blue for air, red for the first component, and green for the second component.

In a second aspect the present invention relates to a coupler for use in the present system. The coupler comprises one or more of a means for connecting, such as a coupler, such as a bayonet coupling, a means for regulating pressure, a means for monitoring pressure, a valve, a handle, a tube for providing pressure, a tube for providing the first component to a spray gun, and a tube for providing the second component to a spray gun, wherein the tubes are preferably colour coded. The coupler provides for an improved mixing of the two components and reduces overspray significantly. It also provides enough shear upon application, in order for the components to provide sufficient adhesive properties, such as initial tack, and further improves a spraying pattern.

In an example the present coupler comprises a coupler ⅝" BSP, a stainless steel ball valve 10.0⅝" male×⅝" female, a nozzle SS for tube 10 mm+wing nut ⅝" BSP, a reducing ring ⅝×½ BSP, a nipple ½×¼ BSP, an air regulator ¼"-04, a manometer 0-4 bar 40⅛", a nipple BN ¼"×¼", a tee ¼" SSt 316, a push in fitting ¼" bu.dr.×8 mm, a hose clamp 11-17 mm ABA, a push in adaptor ⅝" BSP×5/16" tube OD, and a push in fitting.

In a third aspect the present invention relates to a method of filling a disposable container according to the invention with a component, comprising the steps of depressurizing an inner vessel, filling the inner vessel with the component, shielding the component from air, and preparing the container for shipment, such as by sealing. As such the present inventors can supply the present system to users thereof, filled with a first and second component, respectively. Such filling can be controlled well at a location of the present inventors, and users can directly use the filled containers.

In a fourth aspect the present invention relates to a disposable container filled with a first or second component, such as obtainable by a method according to claim 13. The present containers can be sold, distributed, and transported directly to customers.

The invention is further detailed by the accompanying figures and examples, which are exemplary and explanatory of nature and are not limiting the scope of the invention.

The scope of protection is defined by the present claims.

SUMMARY OF FIGURES

FIG. 4 shows a container.
FIG. 5 shows a system 200.

DETAILED DESCRIPTION OF FIGURES

Figure 1:
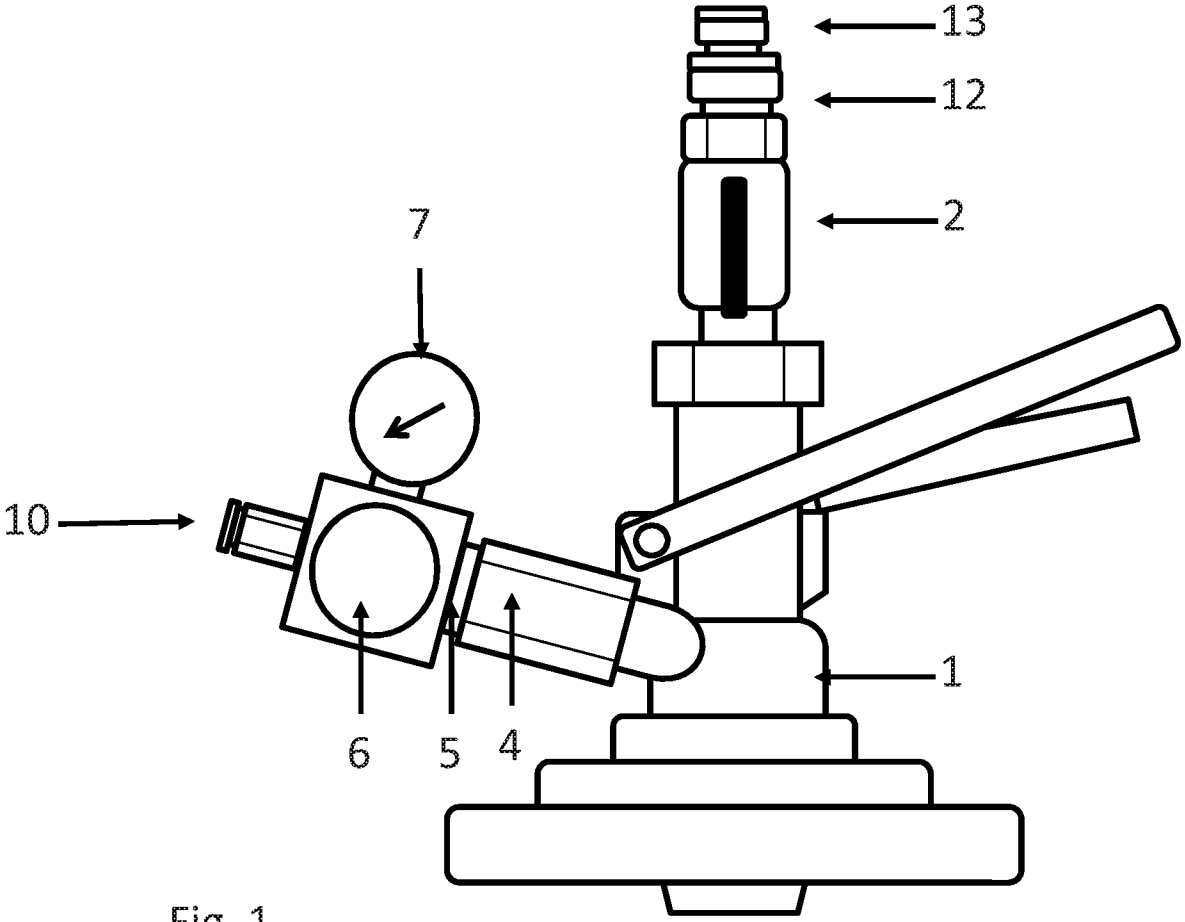
FIGS. 1-3 show couplers.
Figure 2:
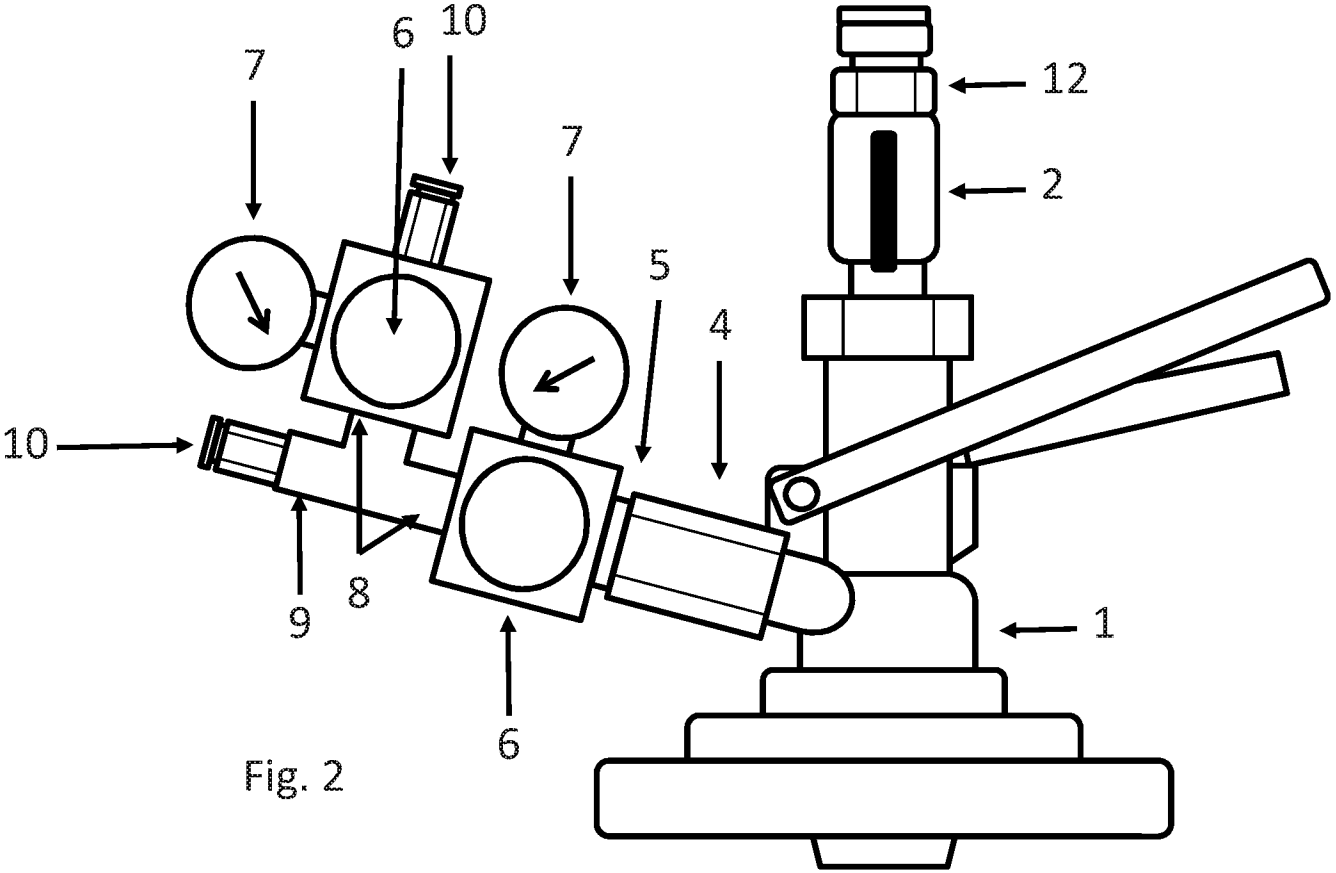
Figure 3:
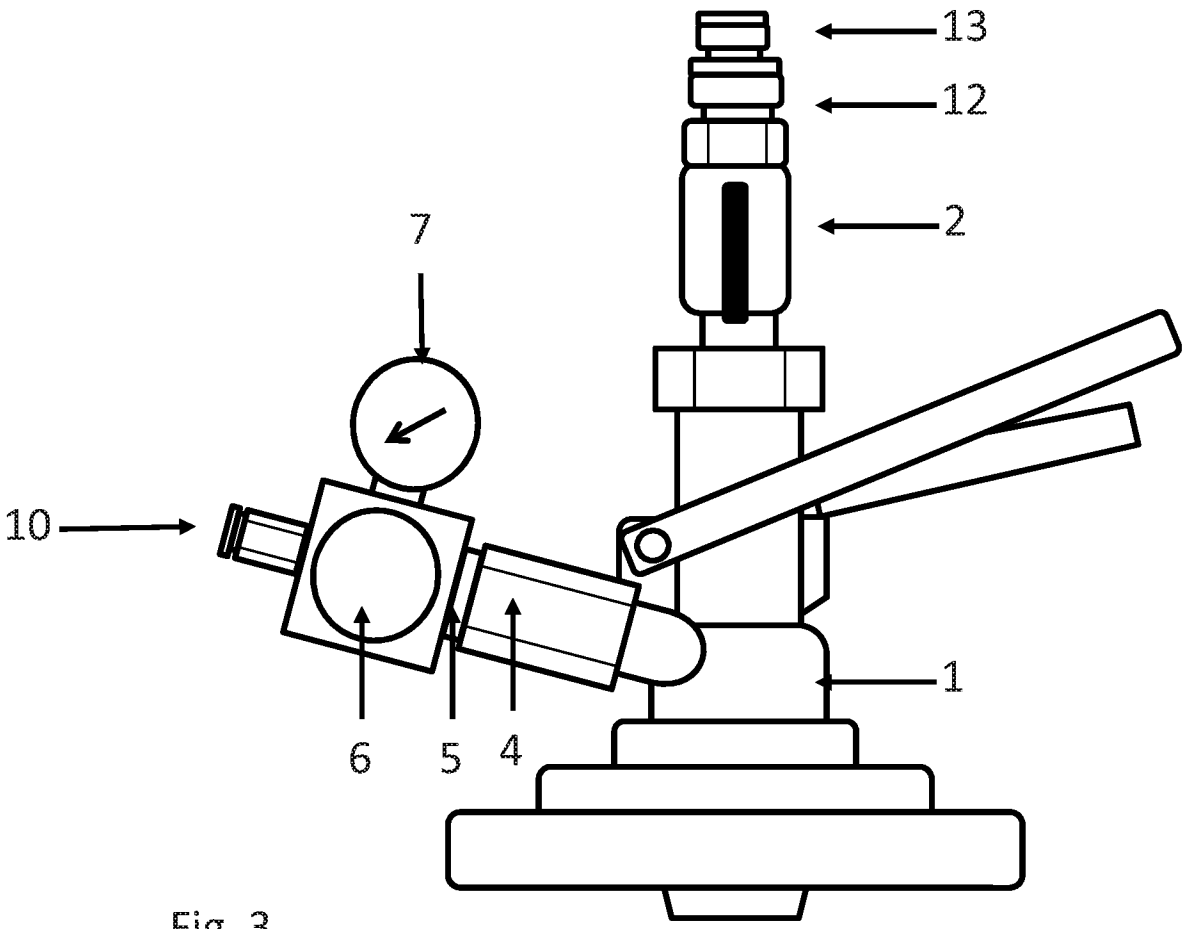

In FIGS. 1-3 a coupler is shown. Therein the following items are shown:

1 Coupler ⅝" BSP
2 Stainless steel ball valve 10.0⅝" male×⅝" female
3 Nozzle SS for tube 10 mm+wing nut ⅝" BSP
4 Reducing ring ⅝×½ BSP
5 Nipple ½×¼ BSP
6 Air regulator ¼"-04
7 Manometer 0-4 bar 40⅛"
8 Nipple BN ¼"×¼"
9 Tee ¼" SSt 316
10 Push in fitting ¼"×8 mm
11 Hoseclamp 11-17 mm ABA
12 Push in adaptor ⅝" BSP×5/16" tube OD
13 Push in fitting FIG. 4 shows a container 100. Therein an outer wall 52 and an inner flexible vessel 51 for shielding the component from air and for pressurizing the component are shown. In between the outer wall and inner flexible vessel pressure can be provided, e.g., by air 53. In the figure the inner vessel comprises a component. The inner vessel is partly emptied in the figure.

FIG. 5 shows a system 200. Therein two containers 100*a* and 100*b* are provided, having a first and second adhesive component respectively. The containers are provided with pressure 53, such as by 200 kPa air pressure. As a result components flow through tubes 57*a* and 57*b*, respectively, attached by a coupler to the container, towards a spray equipment 80. The spray equipment may be a hand-held equipment. The adhesive may then be applied.

The invention although described in detailed explanatory context may be best understood in conjunction with the accompanying figures.

It should be appreciated that for commercial application it may be preferable to use one or more variations of the present system, which would similar be to the ones disclosed in the present application and are within the spirit of the invention.

What is claimed is:

1. A system for a two component adhesive comprising:
a first disposable container, and
a second disposable container, each container capable of withstanding a pressure of 10 kPa-1000 kPa, and
each container (100) comprising an outer wall (52), and wherein
the first disposable container comprises a first adhesive component,
the second disposable container comprises a second adhesive component, and each container comprises a disposable inner flexible vessel comprising the adhesive component for shielding the adhesive component from air and for pressurizing the adhesive component, a tube providing the first adhesive component to a spray gun, a tube providing the second adhesive component to the spray gun, a pressure regulator for each container, a pressure monitor for each container, and a valve for each container.

2. The system according to claim 1, additionally comprising a pressurizer of the first and second container selected from the group consisting of one or more of a pressurized air conduit, a compressor, and a pressurized air cylinder.

3. The system according to claim 1, wherein the containers are formed of a material having a density of less than 1.4 $kg/dm^3$, and wherein the containers have a volume of 10-100 $dm^3$.

4. The system according to claim 1, wherein a material of the inner flexible vessel is made of an inert material, preferably chosen from polyethylene (PE), polyethylene terephthalate (PET), polypropylene (PP), and wherein the outer wall is made of a polymer material.

5. The system according to claim 1, wherein a material of the inner flexible vessel further comprises a reflecting material.

6. The system according to claim 1, wherein the inner vessel is provided with an outlet and a connector for connecting a tube.

7. The system according to claim 1, wherein a space between the inner vessel and outer wall is designed to pressurize the inner vessel.

8. The system according to claim 1, wherein the first adhesive component is selected from the group consisting of a poly-chloroprene dispersion, polyurethane dispersion, polyacrylate dispersion, vinylacetate-ethylene dispersion, ethylene-vinylacetate dispersion, natural rubber dispersion, styrene-butadiene-styrene copolymer dispersion, and styrene-butadiene rubber dispersion, and wherein the second adhesive component is a coagulant.

9. The system according to claim 1, further comprising wherein the spray gun a 2K spray gun or an airless spray gun.

10. The system according to claim 1, further comprising one or more of a connector, a handle, and a tube providing pressure.

11. The system according to claim 1, further comprising a coupler, the coupler comprising one or more of the group consisting of a connector, a pressure regulator, a pressure monitor, a valve, a handle, a tube providing pressure, the tube providing the first adhesive component to the spray gun, and the tube providing the second adhesive component to the spray gun.

12. The system according to claim 11, wherein the coupler comprises one or more of the group consisting of a stainless steel ball valve, a nozzle, a reducing ring, a first nipple, an air regulator, a manometer, a second nipple, a tee, a push in fitting, a hose clamp, a push in adaptor, and a push in fitting.

* * * * *